US006497170B1

(12) United States Patent
Kathe

(10) Patent No.: US 6,497,170 B1
(45) Date of Patent: Dec. 24, 2002

(54) MUZZLE BRAKE VIBRATION ABSORBER

(75) Inventor: Eric L. Kathe, Ballston Lake, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/898,376

(22) Filed: Jul. 5, 2001

(51) Int. Cl.[7] ..... F41A 21/36
(52) U.S. Cl. ..... 89/14.3; 89/14.2
(58) Field of Search ..... 89/14.3, 14.2

(56) References Cited

U.S. PATENT DOCUMENTS

| | | | | | |
|---|---|---|---|---|---|
| 2,444,910 | A | * | 7/1948 | Barker | |
| 2,685,822 | A | * | 8/1954 | Walton | 74/574 |
| 2,765,162 | A | * | 10/1956 | Wulff | 188/289 |
| 3,662,648 | A | * | 5/1972 | Maillard | 267/181 |
| 3,714,864 | A | * | 2/1973 | Thierry | 89/14.3 |
| 3,751,954 | A | * | 8/1973 | Ezra et al. | 29/421.2 |
| 4,476,969 | A | * | 10/1984 | Dykema | 188/380 |
| 4,913,031 | A | * | 4/1990 | Bossard et al. | 42/1.06 |
| 5,505,118 | A | * | 4/1996 | Arnesen et al. | 89/14.3 |
| 5,509,345 | A | * | 4/1996 | Cyktich | 42/97 |
| 5,814,757 | A | * | 9/1998 | Buss | 89/14.3 |
| 5,834,675 | A | * | 11/1998 | Boss | 235/408 |
| 6,167,794 | B1 | * | 1/2001 | Kathe | 42/76.01 |
| 6,196,108 | B1 | * | 3/2001 | Murello | 89/198 |
| 6,250,198 | B1 | * | 6/2001 | Vendetti et al. | 42/75.02 |
| 6,269,727 | B1 | * | 8/2001 | Nigge | 89/14.3 |

FOREIGN PATENT DOCUMENTS

| | | |
|---|---|---|
| BE | 510651 | * 10/1953 |
| DE | 745358 | * 3/1944 |
| GB | 241408 | * 12/1911 |
| GB | 018491 | * 6/1913 |

* cited by examiner

*Primary Examiner*—Michael J. Carone
*Assistant Examiner*—Troy Chambers
(74) *Attorney, Agent, or Firm*—John F. Moran; Michael C. Sachs

(57) ABSTRACT

A muzzle brake vibration absorber for use on a gun barrel is used to store potential energy during gun firing and re-introduce the energy, in part, to the gun barrel out of phase relative to the gun barrel motion. As a result, the deviation of the gun barrel is mitigated to improve the overall accuracy of the gun system. Additionally, the muzzle brake vibration absorber may compliment the functions of a muzzle brake or fuze setting device for the gun system.

16 Claims, 4 Drawing Sheets

MUZZLE BRAKE VIBRATION ABSORBER

GOVERNMENT INTEREST

The invention described herein may be manufactured, licensed, and used by or for the U.S. Government.

BACKGROUND OF THE INVENTION

1. Field of the Invention

The present invention relates to a muzzle brake vibration absorber for use on a gun barrel. More particularly the muzzle brake vibration absorber is used to store potential energy during gun firing and re-introduce the energy, in part, to the gun barrel out of phase relative to the gun barrel motion. This results in the firing deviation of the gun barrel being mitigated. Most particularly, the muzzle brake vibration absorber also may function as, or in combination with, a muzzle brake or fuze setting device for the gun system.

By improving the accuracy of the gun system, the gun system provides a greater operational efficiency through greater accuracy. This decreases the logistical burden to resupply ammunition to operational combat units.

2. Brief Description of the Related Art

Numerous attempts have been made to improve the accuracy of gun weapon systems, particularly those guns systems that are subject to vibrational disturbance during firing. With gun systems becoming increasingly accurate, the affect of vibrational disturbances on gun accuracy has become more pronounced. Additionally, the use of longer and more slender gun barrels, such as that on the XM291 tank gun system, for providing higher projectile exit velocities increases the occurrence of flexural vibrations within the gun systems.

Several methods have been used to improve the accuracy of gun weapon systems.

One method includes the extension of the gun mount/cradle of the gun systems. One means of reducing the receptance of a gun barrel to flexural vibrations is to decrease the effective cantilevered length of the gun system. This may be achieved by increasing the length of the supporting structure that holds the gun barrel which effectively increases the ratio of stiffness to inertia of the system. The square of the ratio of stiffness to inertia is indicative of the resistance of a gun barrel to low frequency vibrations.

A variation on the extended mount approach has been to utilize a traditional mount to support the gun barrel, and to incorporate damping pads through a mount extension that couples the barrel to the cradle with low stiffness and high damping. The result is that the mount extension need not be as solid, since increased stiffness is not the primary objective of the approach. An example of this approach is the British 30 mm, L21A1, system commonly called the RARDEN. (see Geeter et al., "Low Dispersion Automatic Cannon System (LODACS) Final Report (U)," ARDEC Technical Report ARSCD-TR-8201 1, Picatinny Arsenal, New Jersey, August 1982).

Although the extension of the gun mount/cradle may succeed in reducing vibrations, it can present a negative impact of increasing the imbalance of several gun weapon systems, since the center of gravity of typical gun systems is forward of the trunnion bearings. This imbalance necessitates the application of control torques, equal and opposite to the weight of the gun weapon system, multiplied by the horizontal offset of the center of gravity from the pivot point. These requirements places a heavy burden on the pointing system.

Further, for many gun systems extension of the gun mount/cradle becomes ungainly as the ratio of in-mount barrel length to overall barrel length increases. Packaging such support structures in a fielded weapon system becomes difficult.

Another approach has been the incorporation of thicker gun barrels. Gun barrels may be constructed with thicker walls. Since the stiffness is a function of the outer radius to the fourth power, and the inertia is a function of the outer radius to the second power, significant increase to the ratio of stiffness to inertia of the system can be made.

Thicker gun barrels increase the ratio of stiffness to inertia, but require a significant ratio between the inner radius (the radius of the bore) and the outer radius. If the wall thickness, that is the difference between the inner and outer radii, is reasonably small relative to either radius, a thin walled approximation would have the inertia and stiffness increase proportionally to each other, thus no net gain. For example, a Taylor series expansion of the ratio of stiffness to inertia as a function of outer diameter is dominated by the linear term for barrels whose wall thickness is a fraction of the bore radius. The second term exists, but it doesn't dominate until the wall thickness becomes impractical.

A related problem with this approach is that increased weight of the barrel is a direct consequence. This exacerbates both the extension of the center of gravity of the gun further out from the trunnions, and increases overall weapon weight which is supposed to be minimized.

A composite barrel construction is another approach. Gun barrels may be constructed of materials with a higher stiffness to inertia ratio, such as carbon fiber reinforced epoxy, or composite over-wraps of traditional gun steel barrels. The goal is to increase the net ratio of stiffness to inertia of the system, and this can be achieved. This is discussed in Hasenbein, et al., "Metal Matrix Composite-Jacketed Cannon Tube Program," ARDEC-Benét Technical Report ARCCB-TR-9 1027, Watervliet Arsenal, NY, August 1991.

Composite barrel construction is a viable means to enhance the structural stability of gun weapon systems. It is, however, challenged by the need to protect the barrel from the hot and erosive action of the propellant gases. This typically results in a composite over-wrap incarnation over a thin-walled steel barrel. The remaining challenge is to maintain the bond between the base material and the composite over-wrap during both manufacture, especially the autofrettage process, and the firing loads which create concurrent radial dilation of the barrel and axial recoil loads. This firing dynamic challenge is exacerbated by the pressure discontinuity that travels behind the obturation of the projectile with a speed that may resonant a traveling flexural wave of the bore surface. Other challenges include impaired heat transfer across the insulting composite and increase recoil velocity of the cannon during operation.

Fluted gun barrels also have been used. Gun barrels may be constructed with flutes that look like fins emanating from the center of the gun. In analogy with design of an I-Beam the general design concept is to get the steel at a greater radius for an increased stiffness; without increasing the inertia in proportion. An example of this approach is the British 30-mm, L21A1 system commonly called the RARDEN. (See Geeter, et al., "Low Dispersion Automatic Cannon System (LODACS) Final Report (U)," ARDEC Technical Report ARSCD-TR-;82011, August 1982). However, fluted gun barrels are expensive to manufacture, increase system weight, and compromise a desirable static stress distribution that is manufactured into most large caliber gun barrels using a process called autofrettage.

The application of active controls and feed-forward cancellation has been used. If the input excitation can be anticipated, a control signal can be applied through an actuation system to preempt the disturbance energy. An example for a tank gun system while traversing rough terrain would be the use of a sensor to detect vertical acceleration of the tank hull, and apply immediate counteraction force through the elevation actuator system. In many tank guns the center of gravity extends forward of the trunnion bearings. This is a result of the limited working volume within the armor protected turret. Thus, a vertical heave upwards applies a torque to the gun system that may be cancelled by an applied downward force at the elevation coupling, behind the trunnions. For current systems, feed-forward cancellation treats the gun barrel as a rigid body, and ignores flexural modes, and in particular the first flexural mode.

The concept behind active feed-back vibration cancellation is to sense the vibrations of the structure under control, both amplitude and phase, and to apply control forces to the structure to cancel the detected vibrations. This requires both sensors, actuators, and the design of a stable control law; a means to determine what load to apply based on sensor information and a priori knowledge of the dynamic behavior of the system.

Active feed-back vibration cancellation has fundamental problems with structural control. The partial differential equations that govern the vibrations of continua are termed stiff. In this context "stiff" implies that structures contain many natural modes of vibrations with a wide variation in the time-constants or frequencies of response. Thus, although a gun barrel may be dominated by its first mode, on the order of 20 Hz for a tank gun system, it posses vibratory modes with fundamental frequencies orders of magnitude higher. The result of this is that the speed of response required of any active control system is high, and may become impractical.

Additional challenges to feed-back vibration cancellation are stability related. Fundamentally, this type of active control attempts to cancel vibration energy with high force input to the structure. Relatively small discrepancies in the sensors and actuation can result in adding vibrational energy to the structure. This energy often collects in vibratory modes that were not included in the control formulation, particularly that, as a "stiff" system there are many natural modes. Thus, the vibration energy may not even be seen by the sensor system, or may migrate to frequencies that are too high for the actuation system.

Yet another challenge with this feed-back vibration approach is that the free-end of the gun barrel exhibits the most vibration; it is the anti-node of the structure and yet it is removed from control forces by the cantilevered barrel length. From the perspective control system design theory the implication of this is that the system exhibits "non-minimum-phase" behavior. This behavior limits the so-called control gain that may be applied to the system because high gains may drive the system unstable. In other terms, the controlled system exhibits right-hand Laplace plane zeros. These zeros cause the locus of system poles to cross the imaginary axis from the left-hand-plane to the right as the feedback gain is changed. Once in the right hand plane, a pole drives the system unstable with ever increasing amplitude.

Smart structures also may be used. Similar to the feed-back vibration cancellation technology previously described, smart structures include both actuation and sensor transducers to reduce-control vibrations within the structure itself. In the case of a gun barrel, a smart structure approach would entail the coupling of sensor and control mechanisms along the cantilevered span of the barrel. The main difference with the feed-back control method is that the dynamic system of the gun structure itself is changed. Additionally, smart structures tend to be expensive and difficult to manufacture, especially for a gun barrel shock and vibration environment.

In view of the foregoing, there is a need for improvements for increasing the accuracy of gun systems. The present invention addresses this and other needs.

SUMMARY OF THE INVENTION

An object of the present invention is to provide a muzzle brake vibration absorber for use on a gun barrel to increase the accuracy of the gun system.

The present invention includes a muzzle brake vibration absorber for a gun weapon system comprising a vibration absorber mass and means for storing potential energy between the vibration absorber mass and a free end of a gun barrel effective to provide an elastic coupling therebetween.

The present invention also includes a method for stabilizing a gun weapon system for firing comprising the steps of providing a muzzle brake vibration absorber on a gun weapon system having a vibration absorber mass and means for storing potential energy between the vibration absorber mass and a free end of a gun barrel effective to provide an elastic coupling between the mounting collar and the vibration absorber mass and firing the gun weapon system, wherein the vibrational disturbance of the gun decreases.

Additionally, the present invention includes a stabilized gun weapon system product made from the process comprising the steps of providing a muzzle brake vibration absorber on a gun weapon system having a vibration absorber mass and means for storing potential energy between the vibration absorber mass and a free end of a gun barrel effective to provide an elastic coupling between the mounting collar and the vibration absorber mass and firing the gun weapon system, wherein vibrational disturbance within the gun decreases.

Other and further advantages of the present invention are set forth in the description and appended claims.

DETAILED DESCRIPTION OF THE PREFERRED EMBODIMENTS

The present invention includes a muzzle brake vibration absorber for a gun system. The muzzle brake vibration absorber of the present invention combines a specially tuned forward mass elastically suspended at the muzzle end of the gun system cannon that works in combination with a muzzle brake. The muzzle brake vibration absorber provides increased accuracy and enhanced structural stability of gun systems that are subject to dispersion caused by the vibration of the cannon barrel. The forward mass, or vibration absorber mass, also may serve as an induction coil for a muzzle set fuze system. Additionally, the vibration absorber mass may include the functions of a muzzle brake. The present invention is particularly useful on medium caliber rapid-fire systems, such as chain guns typified by the M242 bushmaster or for large caliber guns subject to servo stabilization that require a large muzzle brake for momentum reduction during firing.

The elastically suspended vibration absorber mass significantly reduces the flexural vibrations of the gun barrel, resulting in a significant increase in the accuracy of the weapon system. Reduction in vibrational by the present invention occurs frequency bands that may exceed the bandwidth of the servo stabilization control system. As such, the present invention increases the potential for existing stabilization control to reduce the remaining vibrational energy that remains after incorporation of the present invention.

Figure 1:
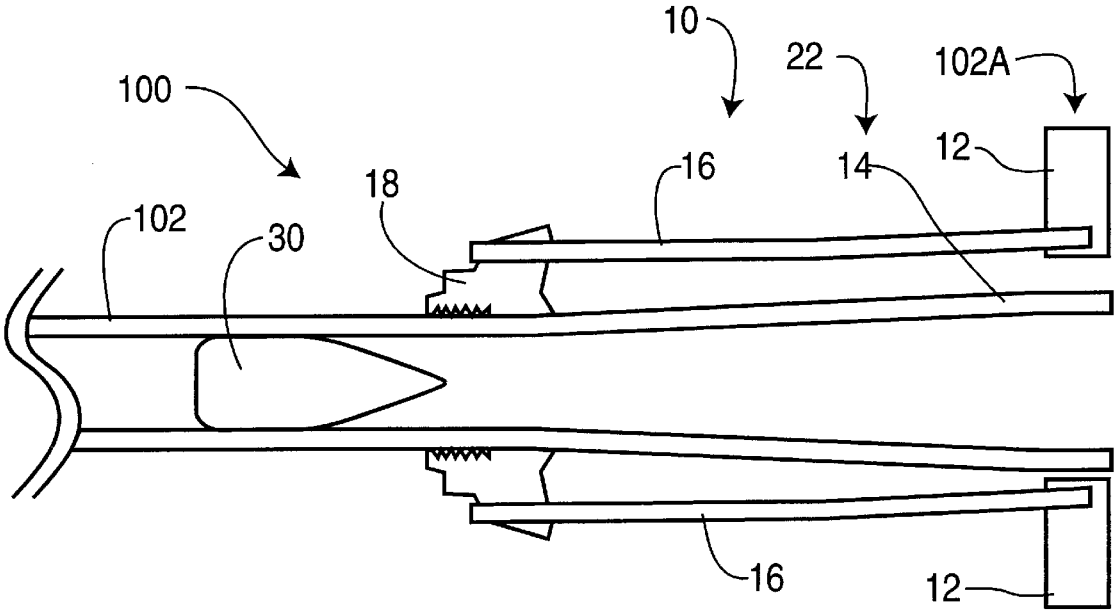
FIG. 1 illustrates a muzzle brake vibration absorber of the present invention.

As seen in FIG. 1, a muzzle brake vibration absorber 10 of the present invention useful for stabilizing the gun barrels 102 of gun weapon systems 100 is illustrated. The muzzle brake vibration absorber 10 includes a vibration absorber mass 12 together with a means for storing potential energy 22 between the vibration absorber mass 12 and a free end 102A, or muzzle end, of a gun barrel 102. The vibration absorber mass 12 of the present invention may comprise any appropriate mass as determinable by those skilled in the art in light of the disclosure herein, for example, such as a mass of from about 1% to about 25% of the mass of the gun barrel 102. The means for storing potential energy 22 between the vibration absorber mass 12 and the muzzle end 102A of the gun barrel 102 provides an effective elastic coupling between the vibration absorber mass 12 and the muzzle end 102A.

As further seen in FIG. 1, the vibration absorber mass 12 of the muzzle brake vibration absorber 10 is connected to a mounting collar 18 at the end of the muzzle end 102A of the gun barrel 102. The vibration absorber mass 12 is connected with spring rods 16 to the mounting collar 18 to form a sound structure. This sound structure reduces the vibration of the gun barrel 102, thus reducing the gun dynamic contributions to dispersion of a fired projectile 30, i.e., the gun will shoot straighter and/or more consistently. The vibration absorber mass 12 stores and releases the kinetic energy of vibration that occurs with the firing of the gun system 100, with the energy transferred to the vibration absorber mass 12 through the spring rods 16. Additionally, the inertial property of vibration absorber mass 12 manifests a resistance to gun barrel 102 motion during firing.

The mounting collar 18 attaches to the muzzle end 102A of the gun barrel 102. The mounting collar 18 is a device used to attach the spring rods 16 and vibration absorber mass 12 to the muzzle brake 14. The mounting collar 18 provides amounting that is rigid and able to withstand the forces applied during firing of the gun system 100. Non-rigid mounting affects the spring rate of the spring rods 16, blurring the distinction between the elasticity of the mounting collar 18 and the spring rods 16, as well as dissipating energy as friction which would alter, in a potentially favorable manner, the performance of the muzzle brake vibration absorber. The mounting collar 18 is mounted to the muzzle end 102A of the gun barrel 102 in any suitable manner as determinable by those skilled in the art in light of the disclosure herein, such as being a component part, i.e., integral to, the gun barrel 102 or attached to a gun muzzle brake 14 on the gun barrel 102. The mounting collar 18, similarly, may be mounted to the gun barrel 102 as a component part or attached. Fixture of the mounting collar 18 is done in such a manner as to minimize any displacement between the gun barrel 102 and the mounting collar 18 during firing of the gun system 100.

A muzzle brake 14 of the muzzle brake vibration absorber 10 redirects the flow of burnt propellant gases during firing of the gun system 100 outwards, and possibly rearwards, to reduce forward momentum that is imparted to the combustion gases during firing of the gun system 100. The redirection of forward moving gases reduces the recoil impulse at the gun mount and recoil system of the gun system 100.

Although shown herein as spring rods 16, connection between the mounting collar 18 and vibration absorber mass 12 may include any appropriate storing mechanism for conveying the potential energy into the vibration absorber mass 12. Exemplary storing mechanisms include steel spring rods, rubber spring rods, pneumatic piston, electromagnetic fields, integral collar and other like devices that provide a structurally sound connection between the mounting collar 18 and vibration absorber mass 12.

Figure 2:
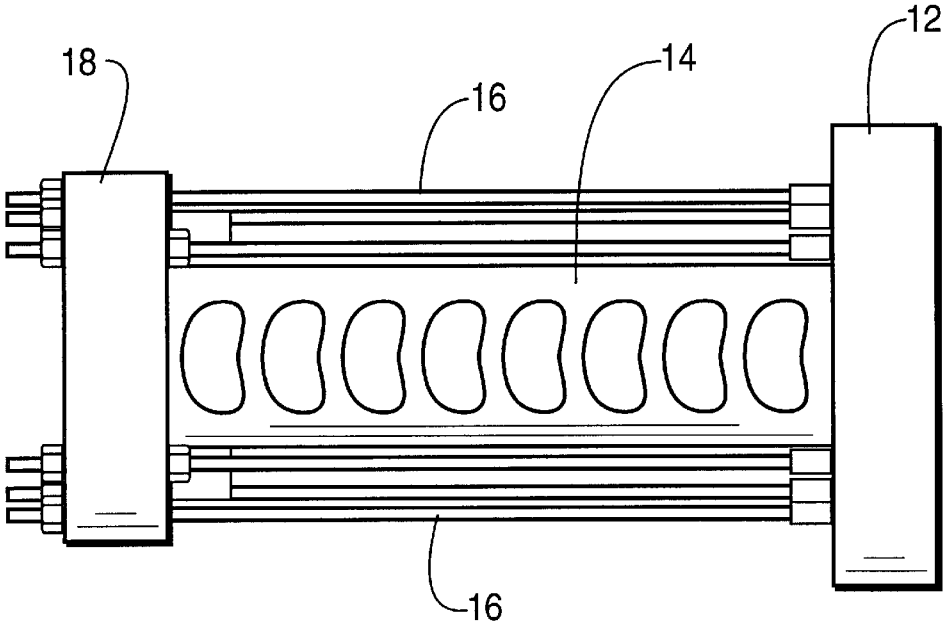
FIG. 2 is a side view of the muzzle brake vibration absorber with spring rods attached between a vibration absorber mass and mounting collar.

As seen in FIG. 2, a multitude of spring rods 16 may be used to attach the vibration absorber mass 12 to the mounting collar 18. These spring rods 16 provide an elastic coupling between the muzzle brake 16 and the vibration absorber mass 12 that stores and releases potential energy of vibration. Conceptually, the spring rods 16 provide beam bending resistance to the relative deflection between the vibration absorber mass 12 and the muzzle brake 16. The spring rods 16 may be viewed as being bent to represent the computed fundamental mode shape for the spring rods 16, with the boundary condition for the left end of the spring rods 16 cantilevered. The right side of the spring rods 16, would remain deflection free, but rotation is fixed. This occurs because the plane of the vibration absorber mass 12 and the mounting collar 18 remain parallel under the Euler beam assumption with negligible axial extension of the spring rods 16.

Spring rods 16 are the preferred connection between the mounting collar 18 and vibration absorber mass 12 within means for storing potential energy 22. As seen in FIGS. 1 and 2, preferably the spring rods 16 are structurally attach to the vibration absorber mass 12 and are positioned substantially longitudinally along the length of a gun barrel 102. The spring rods 16 provide the structural integrity to keep the vibration absorber mass 16 coupled to the mounting collar 18 during the applied loads of launch. These loads include the recoil acceleration of the gun system 100, the loads applied by the exposed surface area to muzzle blast pressure, etc. Any suitably appropriate spring rod 16 number, configuration, and/or design may be used within the present invention as determinable by those skilled in the art in light of the disclosure herein. Preferably, a substantial number of relatively thin spring rods 16 are employed to provide the net cross sectional area required to survive the tension loads applied by the muzzle gas pressure and rearward acceleration of the vibration absorber mass 12. The number of spring rods 16 more preferably ranges from about 3 to about 12 spring rods, still more preferably from about 4 to about 10 spring rods, and most preferably from about 6 to about 8 spring rods. The plurality of spring rods 16 are necessarily thin to bring the effective stiffness of the combined spring rods 16 down to a level where the muzzle brake vibration absorber 10 functions during gun system operation, i.e., the square root of the ratio of muzzle brake vibration absorber 10 stiffness effected by the spring rods 16 divided by the vibration absorber mass 12 represents the fundamental frequency of muzzle brake vibration absorber 10 in radians per unit time. Since the bending stiffness of the spring rods 16 increases with radius to the fourth power and a cross sectional area goes up with radius to the second power, a large number of thinner spring rods 16 results in a lower frequency vibration absorber that remains capable of enduring the recoil and muzzle blast tensile loads of a fired gun system 100. Distribution of the spring rods 16 may include a plurality of spring rods 16 distributed around the circumference of the gun barrel 102, either evenly or unevenly, as determined for maximum effectiveness. Configuration of the spring rods 16 includes, without limitation, circular, elliptic and/or shaved-circular diameters. Diameters of the spring rods 16 may include any appropriate size, such as from about ⅛ inch to about ¼ inch.

Even though the spring rods 16 are inextensible, when the spring rods 16 assume a non-linear, i.e., non-straight, profile, the distance between the vibration absorber mass 12 and the mounting collar 18 decreases. Under conditions of rearward acceleration during firing of the gun system 100, energy is stored as an integral function of the mass of the vibration absorber mass 12 multiplied by the rearward acceleration over the distance of contraction between the vibration absorber mass 12 and the mounting collar 18. As the acceleration is not constant, the energy stored does not create a linearized model of the dynamics.

This acceleration based potential energy mechanism may be leveraged to tailor loads applied at the muzzle end 102A of the gun system 100 during the launch of the projectile 30. Full leveraging of such design requires active or adaptive components for the mechanism to overcome design sensitivity to the various types rounds fired and other shot to shot parametric and initial condition variations.

The muzzle brake vibration absorber 10 comprises a passive coupling constraint between the muzzle brake 14 and the vibration absorber mass 12 by the spring rods 16 to move energy between the gun barrel 102 and muzzle brake 14, stored energy of the springs (represented by the spring rods 16), and kinetic energy of the vibration absorber mass 12. Any variation that stores deflection energy between the relative motion of the vibration absorber mass 12 and muzzle end of the barrel 102 represents an alternate method. Such mechanisms include pneumatics, rubber springs, and various integral collar configurations in lieu of the spring rods 16.

In operation, the gun weapon system 100 is stabilized during firing by the muzzle brake vibration absorber 10 from a decrease of vibrational disturbances to the gun barrel 102. During firing of the projectile 30, the gun barrel 102 confines the pressure of the combustion propellant gasses and constrains the path of the projectile 30 to follow the center-line of the gun barrel 102.

The direction of discharge of the projectile 30 is greatly influenced by the orientation of the muzzle end of the gun system 100 at shot exit. Although the gun barrel 102 is extremely stiff, the gun barrel 102 flexes prior to, during, and following the launch of the projectile 30. This flexure is compensated by the present invention, reducing the flexure and/or making the flexure more repeatable, leading to reduced dispersion, and increased accuracy, of the gun system 100.

The projectile 30, i.e., the ordinance delivered by the gun system 100, comprises a nearly rigid mass that is constrained to follow the center-line path of the gun barrel 102 as the combustion propellant gases accelerate the projectile 30 through the gun barrel 102. Obturator bands (not shown) may be employed to aid the formation of a seal between the inner bore of the gun barrel 102 and the outer diameter of the rigid projectile 30 to contain the propellant gases behind the projectile 30 during firing of the gun system 100.

Figure 5A:
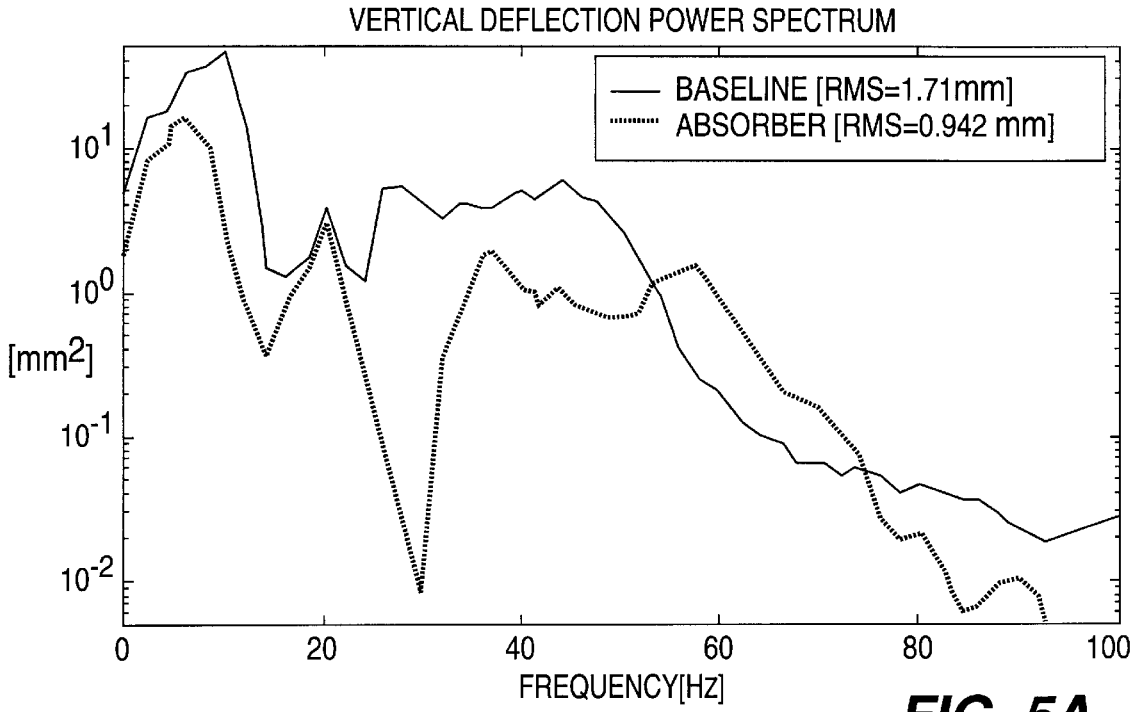
Figure 5B:
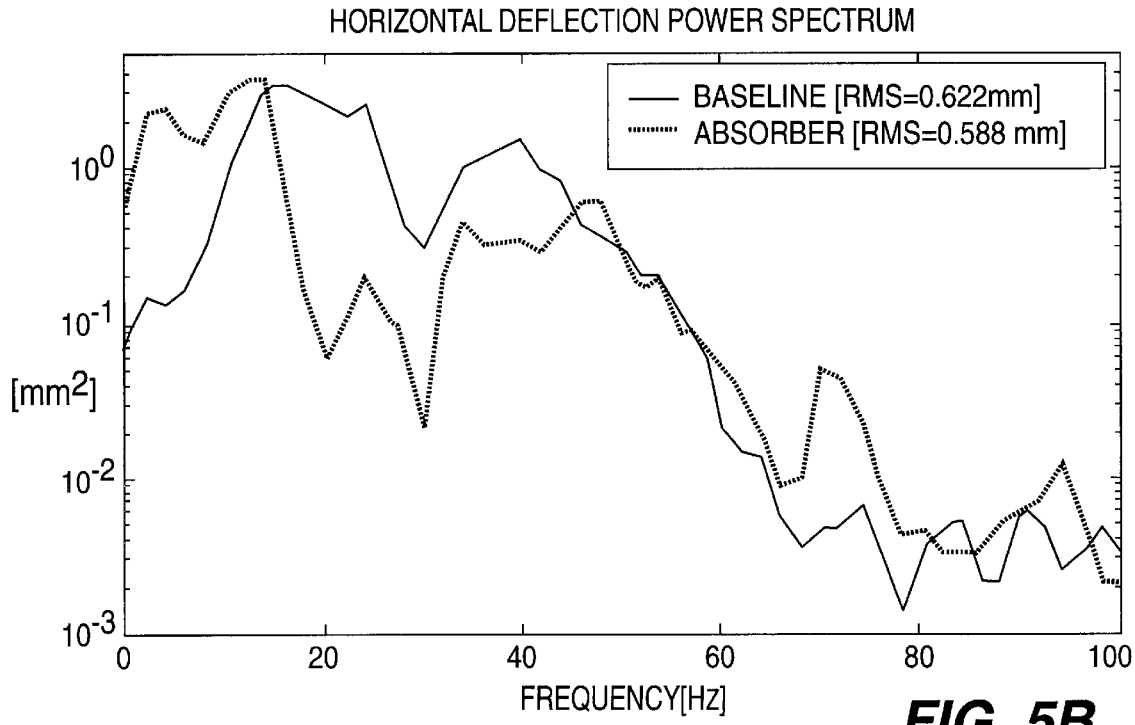

The decrease in disturbance of the gun barrel 102 during projectile 30 firing may be directed to any appropriate frequency as determinable by those skilled in the art, with vibrational frequency decreases at from about 20 Hertz to about 40 Hertz shown in FIGS. 5A and 5B.

During firing of the projectile, the vibration absorber mass 12 may perform several functions within the muzzle brake vibration absorber 10. These functions may include housing an inductive coil for a muzzle set fuze device 40 in combination with the vibration absorber mass 12. The muzzle set fuze device 40 measures the exit velocity of the projectile 30 and sets the fuze to detonate at such time that the ordinance explodes at a precise distance down range. With the muzzle set fuze device 40 incorporated into the muzzle brake vibration absorber 10, the weight of the muzzle set fuze device 40 is used as part of the vibration absorber mass 12. This allows any mass increase associated with the muzzle set fuze device 40 to be utilized as a vibration absorber mass 112 to attenuate barrel vibration and thus increase gun accuracy.

The vibration absorber mass 12 may also perform the functions of a muzzle brake 14. The surface area of the vibration absorber mass 12 may be used to enhance the performance of the muzzle brake 14 in contributing to the redirection of the forward momentum of the propellant gases as they leave the muzzle following discharge of the projectile 30. This deflection of the exhaust gases augments the muzzle brake 14 without necessarily incurring additional weight to the gun system 100. Achievement of the dual use is determinable by those skilled in the art, taking into account muzzle brake design to avoid imparting non-symmetrical gas dynamic loads through a muzzle brake baffle or other surface located radially near enough to the outer diameter of the passing projectile to affect gas passage around the projectile, i.e. the vibrating muzzle brake surfaces must be radially far enough away from the projectile to decouple the mechanical vibration from the aerodynamics of the projectile flight. Other components within a particular gun system, such as blast deflectors represented by block 40 (FIG. 1), also may be incorporated in to the vibration absorber mass 12.

During the launch of a projectile 30 from the gun system 100, the barrel 102 of the gun system 100 is accelerated rearwards with substantial force. This acceleration stores additional potential energy that is not a linear approximation to the muzzle brake vibration absorber 10. The muzzle brake vibration absorber 10 of the present invention advantageously modifies the structural response of the gun barrel 102 within a gun system 100 to forces associated with firing loads, gun point, or other environmental disturbance.

EXAMPLE

An auxiliary sensor surface was mounted to the gun barrel of a tested gun system behind the mounting collar. This provided a flat and non-tapering surface on which a laser based displacement sensor was place to collect muzzle deflection data during the burst fire.

Figure 3A:
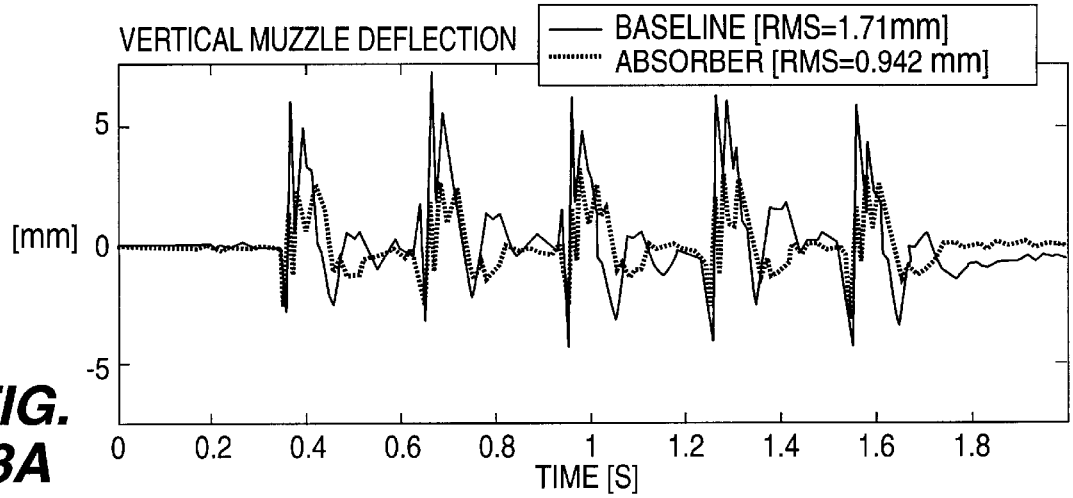
FIGS. 3A–3C are graphical representations comparing the vertical, horizontal and radial muzzle deflections of a gun barrel with and without the muzzle brake vibration absorber of the present invention.
Figure 3B:
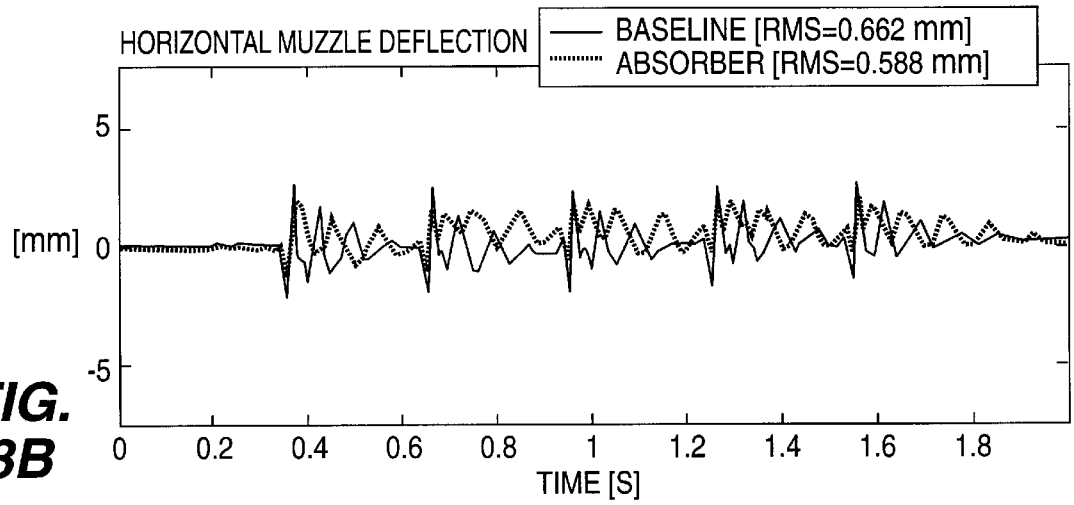
Figure 3C:
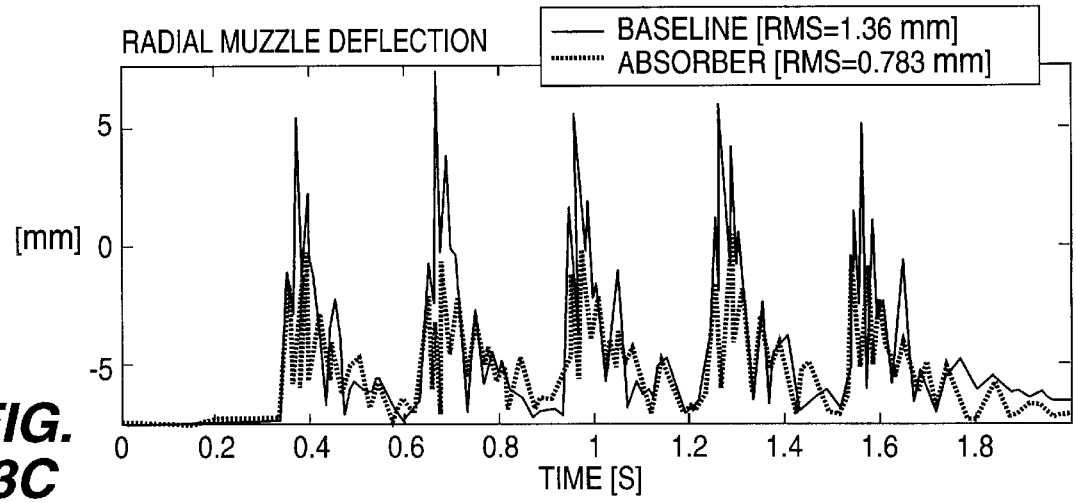

Muzzle deflections during five round (TP-T M793) burst firing of an M242 25 mm Bushmaster cannon were recorded with and without the muzzle brake vibration absorber of the present invention. As seen in the graphical representations of FIGS. 3A–3C, vertical (shown in FIG. 3A), horizontal (shown in FIG. 3B) and radial (shown in FIG. 3C) muzzle deflections of the gun barrel are shown with and without the muzzle brake vibration absorber of the present invention. As seen in FIGS. 3A and 3B, the vibrational deflection in the vertical and horizontal are significantly reduced using the muzzle brake vibration absorber. The results of the radial root-mean-square (RMS) vibration amplitude as shown in FIG. 3C indicate that the vibration was reduced by nearly half.

Figure 4B:
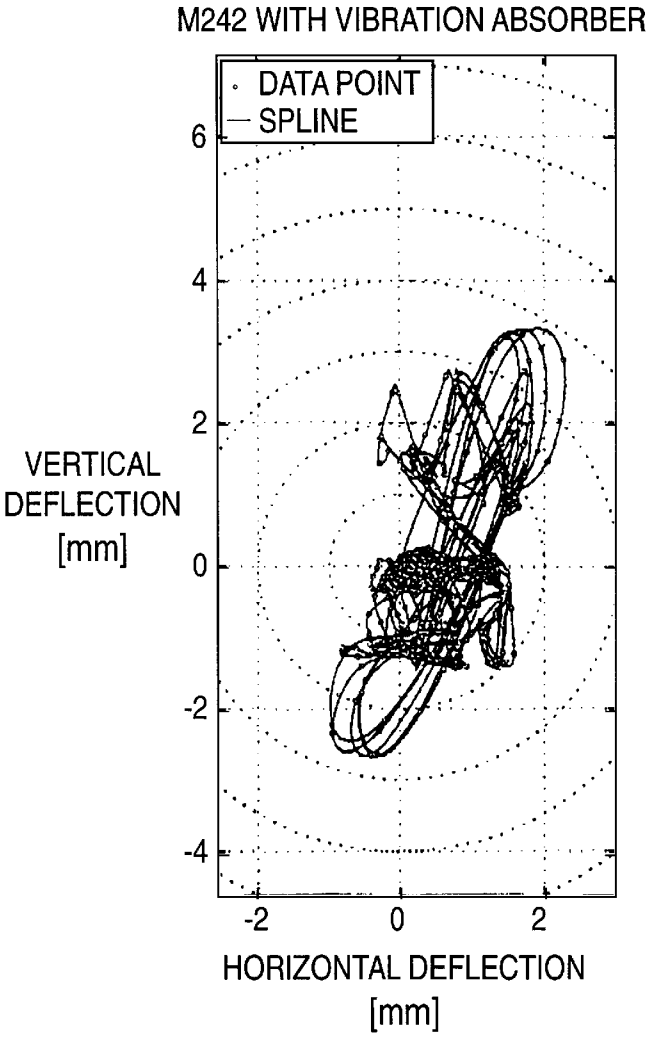
FIGS. 4A and 4B are graphical representations comparing the muzzle orbit plots for a gun barrel firing five rounds with and without the muzzle brake vibration absorber of the present invention; and, FIGS. 5A and 5B are graphical representations of the power spectra of the vertical and horizontal muzzle vibrations shown in FIGS. 3A and 3B.
Figure 4A:
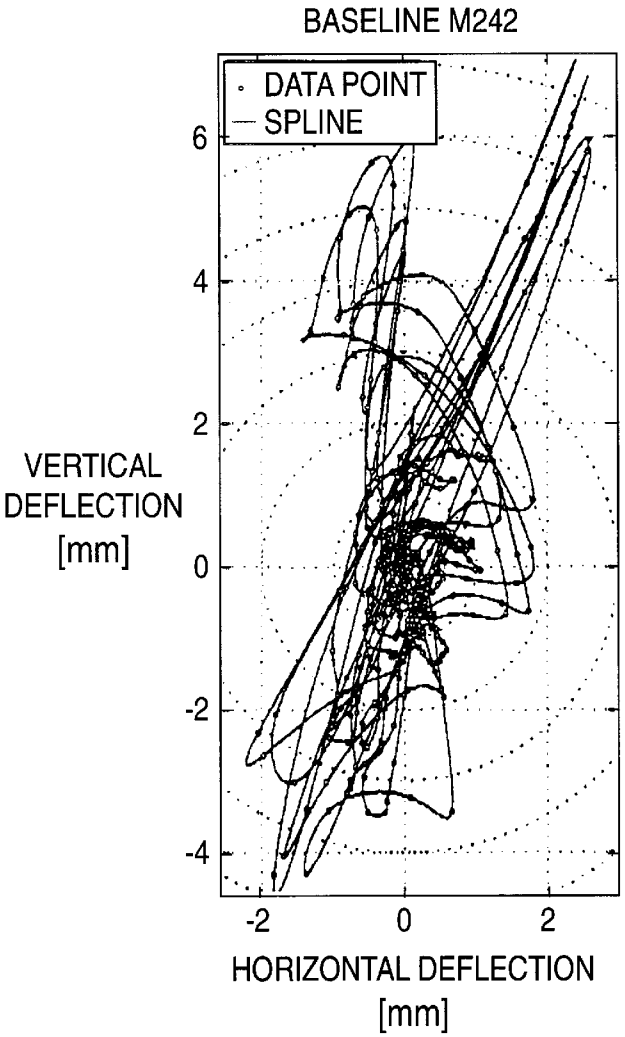

FIGS. 4A and 4B are graphical representations comparing the muzzle orbit plots for a gun barrel firing five rounds with and without the muzzle brake vibration absorber of the present invention. The plots of FIGS. 4A and 4B depict the locus of muzzle deflection throughout the duration of the fire, commonly referred to as a comet plot. The increased tightness and repeatability of the trajectories resulting from the muzzle brake vibration absorber, shown in FIG. 4B, are evident in comparison with the results obtained without the muzzle brake vibration absorber shown in FIG. 4A.

A frequency domain perspective of effect of the muzzle brake vibration absorber on the muzzle vibrations of the gun system during firing are shown in the power spectrum FIG. 5A for the vertical deflection of FIG. 3A and in the power spectrum FIG. 5B for the horizontal deflection of FIG. 3B. These power spectrum indicate a fundamental frequency where in the frequency domain the muzzle brake vibration absorber best functions, such as the "notch" effect near the fundamental frequency as shown near 30 Hz.

It should be understood that the foregoing summary, detailed description, examples and drawings of the invention are not intended to be limiting, but are only exemplary of the inventive features which are defined in the claims.

What is claimed is:

1. A muzzle brake vibration absorber for a gun weapon system including a muzzle that defines a muzzle end, comprising:

a mounting collar secured the muzzle, at a distance from the muzzle end;

a plurality of rods having first and second ends, that provide a bending stiffness to the absorber to effect a desired tuned coupling frequency;

wherein the first ends of the rods are secured to the mounting collar, and wherein the second ends of the rods are positioned in proximity to the muzzle end without touching the muzzle end when in a resting position, so that the mounting collar provides a cantilevered coupling to the rods;

wherein the rods are generally circumferentially dispersed around the muzzle, and the second ends of the rods are radially distributed around, and at a distance from the muzzle end; and a vibration absorber mass that is secured to the second ends of the rods, at a distance from the mounting collar, and that is elastically suspended around the muzzle end, to constrain a free rotational movement of the rods, and to provide a mass to tune a vibration frequency of the mounting collar in conjunction with the bending stiffness provided by the rods wherein the mounting collar is integral with the muzzle.

2. The muzzle brake vibration absorber of claim 1, wherein the mounting collar attaches to a gun muzzle brake.

3. The muzzle brake vibration absorber of claim 2, wherein the mounting collar is mounted to the gun muzzle brake.

4. The muzzle brake vibration absorber of claim 1, wherein the mounting collar is integral to the gun muzzle brake.

5. The muzzle brake vibration absorber of claim 2, wherein the surface area of the gun muzzle brake provides exhaust gas deflection.

6. The muzzle brake vibration absorber of claim 1, wherein the rods include any of spring rods, rubber spring rods, pneumatic piston, electromagnetic fields and integral collar.

7. The muzzle brake vibration absorber of claim 1, wherein the rods comprise steel spring rods.

8. The muzzle brake vibration absorber of claim 1, wherein the rods are positioned substantially longitudinally along an axial length of a gun barrel.

9. The muzzle brake vibration absorber of claim 1, wherein the plurality of rods include about 3 to 12 spring rods.

10. The muzzle brake vibration absorber of claim 9, wherein the plurality of rods include about 4 to 10 spring rods.

11. The muzzle brake vibration absorber of claim 1, wherein the plurality of rods have a cross-section that is generally circular.

12. The muzzle brake vibration absorber of claim 11, wherein the cross-section of the rods varies from about ⅛ inch to about ¼ inch.

13. The muzzle brake vibration absorber of claim 1, further comprising a muzzle set fuze system, wherein the muzzle set fuze system contributes to the vibration absorber mass.

14. The muzzle brake vibration absorber of claim 1, further comprising blast deflectors, wherein the blast deflectors contribute to the vibration absorber mass.

15. The muzzle brake vibration absorber of claim 1 that causes the muzzle to vibrate at a fundamental frequency that is different from a natural vibration frequency of the muzzle; and wherein the fundamental frequency is tunable by altering any one of, or both the vibration absorber mass and bending stiffness.

16. The muzzle brake vibration absorber of claim 15, wherein the fundamental frequency is defined by the square root of the ratio of the bending stiffness effected by the plurality of rods divided by the mass of the vibration absorber mass.

* * * * *